US005242095A

United States Patent [19]

Creapo et al.

[11] Patent Number: 5,242,095

[45] Date of Patent: Sep. 7, 1993

[54] CONTACTLESS AIR TURN GUIDE WITH BAFFLES FOR RUNNING WEBS

[75] Inventors: Ralph W. Creapo; Randall D. Helms, both of Green Bay, Wis.

[73] Assignee: Advance Systems, Inc., Green Bay, Wis.

[21] Appl. No.: 631,247

[22] Filed: Dec. 20, 1990

[51] Int. Cl.[5] ..... B65H 20/14

[52] U.S. Cl. ..... 226/97; 226/197; 34/156; 34/160

[58] Field of Search ..... 226/7, 97, 196, 197, 226/156, 160

[56] References Cited

U.S. PATENT DOCUMENTS

| | | | |
|---|---|---|---|
| 3,549,070 | 12/1970 | Frost et al. | 226/97 |
| 3,587,177 | 6/1971 | Overly et al. | 34/156 |
| 3,873,013 | 3/1975 | Stibbe | 226/97 X |
| 4,271,601 | 6/1981 | Koponen | 226/97 X |
| 4,300,714 | 11/1981 | Dahl et al. | 226/97 X |
| 4,472,888 | 9/1984 | Spiller | 226/97 X |
| 4,790,468 | 12/1988 | Nakashima et al. | 226/97 |
| 4,938,404 | 7/1990 | Helms et al. | 226/10 |

*Primary Examiner*—Stanley N. Gilreath
*Assistant Examiner*—Paul T. Bowen
*Attorney, Agent, or Firm*—Nilles & Nilles

[57] ABSTRACT

A contactless turning guide for floatingly suspending a running web in an arcuate path and comprising a housing having an arcuate surface extending in the direction of web travel, the guide also having leading and trailing edges, an air supply nozzle mounted adjacent and parallel to the leading and trailing edges and extending transversely of the path of the web over the arcuate surface, the nozzle acts to supply air over the arcuate surface, and a baffle extends from adjacent each of the edges and a direction away from the arcuate surface for increasing the velocity of waste air spilling off of the leading and trailing edges and thereby decreasing the pressure of waste air on the web outwardly from the guide.

12 Claims, 2 Drawing Sheets

CONTACTLESS AIR TURN GUIDE WITH BAFFLES FOR RUNNING WEBS

BACKGROUND OF THE INVENTION

1. Field of the Invention

The present invention pertains to advancing material of indeterminate length through an arcuate guide on a cushion of pressurized air. The material is floatingly advanced through the guide without flutter or vibration.

2. Description of the Prior Art

The invention pertains to contactless turning guides for a running web and for guiding and controlling a running web through a change of direction. These turning guides are also commonly referred to as air rolls or air turns and are formed as a partial drum-like member having an arcuately curved surface which can be variable as to it transverse length and also variable as to the length of its arc. These prior art turning guides have a transverse nozzle slot at both the beginning and end of the arcuate path for supplying pressurized air to the air cushion located between the slots over the arcuately curved surface. Prior art contactless turning guides for running webs are disclosed in U.S. Pat. No. 4,182,472 issued on Jan. 8, 1980 and U.S. Pat. No. 4,282,998 issued on Aug. 11, 1981, both to Peekna. Other prior art contactless turning guides are shown in U.S. Pat. No. 4,197,972 which issued Apr. 15, 1980 to Robert A. Daane; U.S. Pat. No. 4,938,404 which issued Jul. 3, 1990 to Daane and Randall Helms, and U.S. Pat. No. 4,925,077 which issued to Daane and Helms on May 15, 1990.

As the web of indeterminate length travels over and beyond the leading or trailing edges of the arcuate surface in these prior art devices, air is spilled back off the arcuate path in a direction generally opposite that of the pressurized air emerging from the nozzle slots. The velocity of the air spilling back off the arcuate path decreases in velocity as it moves away from the edge of the arcuate path and causes an increase in pressure on the web at the edge of and slightly beyond the edge of the arcuate surface. The air is thus destabilized and tends to push the web away from the arcuately curved surface and from its intended path beyond the edge of the arcuate surface having generally the same radius as that surface. This destabilization may cause the web to begin vibrating at high frequency in the air turn which may cause the web to tear and fail. This problem is exacerbated in air turns approaching 90° and with decreasing web tension.

SUMMARY OF THE INVENTION

The present invention provides a contactless turning guide for floatingly suspending a running web through an arcuate path, the guide having air supporting baffles mounted at the leading and trailing edges of its arcuate surface. An air supplying nozzle slot is located adjacent each edge for directing pressurized air over the arcuate surface. Specifically, a baffle or wing extends transversely of the web travel along the length of the leading and trailing edges of the air turn guide. The baffle, in a preferred embodiment, may be mounted to the air turn adjacent its nozzle slot. The baffle extends outwardly in a direction generally tangential to the arcuately curved surface. The active side of the baffle adjacent the web and the path of the web converge in a direction away from the arcuate surface, in a preferred embodiment; the distance between the web and the active side of the baffle adjacent the web decreases with increasing distance from the edge of the arcuately curved surface of the air turn.

Our experiments have shown that the baffle of the present invention thus eliminates flutter and high frequency vibrations even when web tension is low.

DESCRIPTION OF THE PREFERRED EMBODIMENTS

Figure 1:
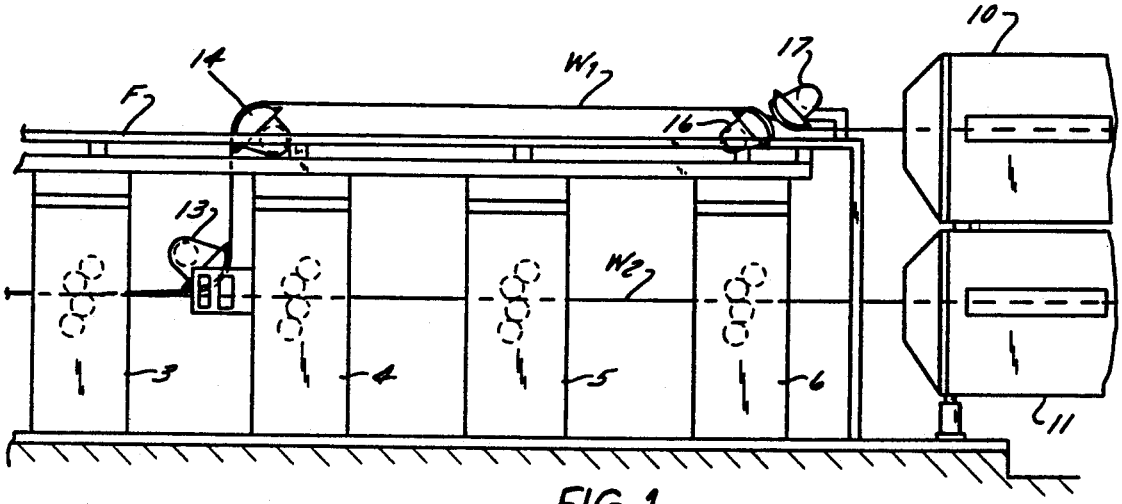
FIG. 1 is a schematic, elevational, side view of a series of web presses from which the web is fed into web dryers, and showing the environment in which the present invention is used.

The general environment in which the present invention is used is shown in FIG. 1 and includes a series of web presses 3, 4, 5, and 6 which are arranged in line in the conventional manner and through which the webs $W_1$ and $W_2$ pass to their respective web dryers 10 and 11. For the purpose of describing the present invention, reference will be made to one of the webs $W_1$ which after leaving the last of its web printing press 3 must be turned at two right angles to position it above the remaining presses. The web subsequently enters the conventional web dryer 10 for further processing. In conducting the web through its path from the last printing press 3 to the dryer 10, a pair of 90° air guides or air turns 13, 14 are used to elevate the web $W_1$ for entry into dryer 10. A pair of 40° turn air guides 16, 17 are also used to floatingly guide the web without contact from the 90° air turn 14 and into the web dryer 10. These 40° air turns or guides 16 and 17 act to rigidify the web by causing it to assume an "S" shape.

Figure 4:
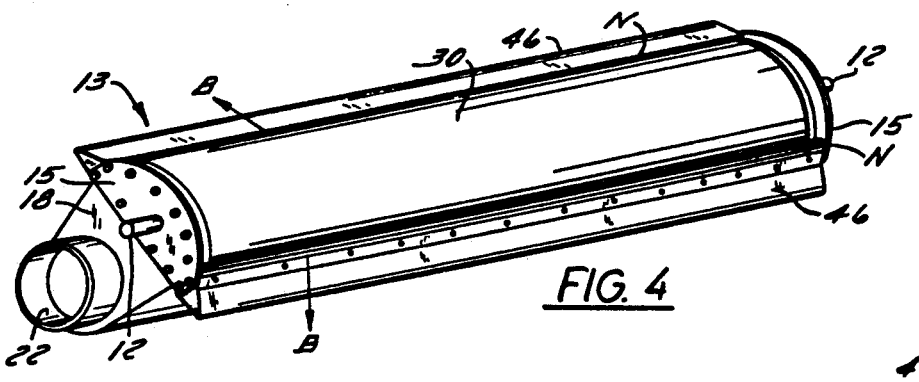
FIG. 4 is a perspective view of a contactless turning guide made in accordance with the present invention and shown in the other views.

The guides 13 and 14 are angularly adjustable on the press frame F by means of their stub shafts 12 (FIG. 4) which rigidly extend from the guide side frames 15 and the shafts are mounted in the framework F (FIG. 1) in the conventional manner. Air is supplied to the 90° air guides 13, 14 in conventional manner such as by a motor driven blower (not shown) which conducts air through various ducting (not shown) to the 90° air guides 13, 14 as well the 40° air guides 16, 17. Reference may be had to the said U.S. Pat. No. 4,938,404 for a more complete description of the air supply blower or ducting.

Figure 2:
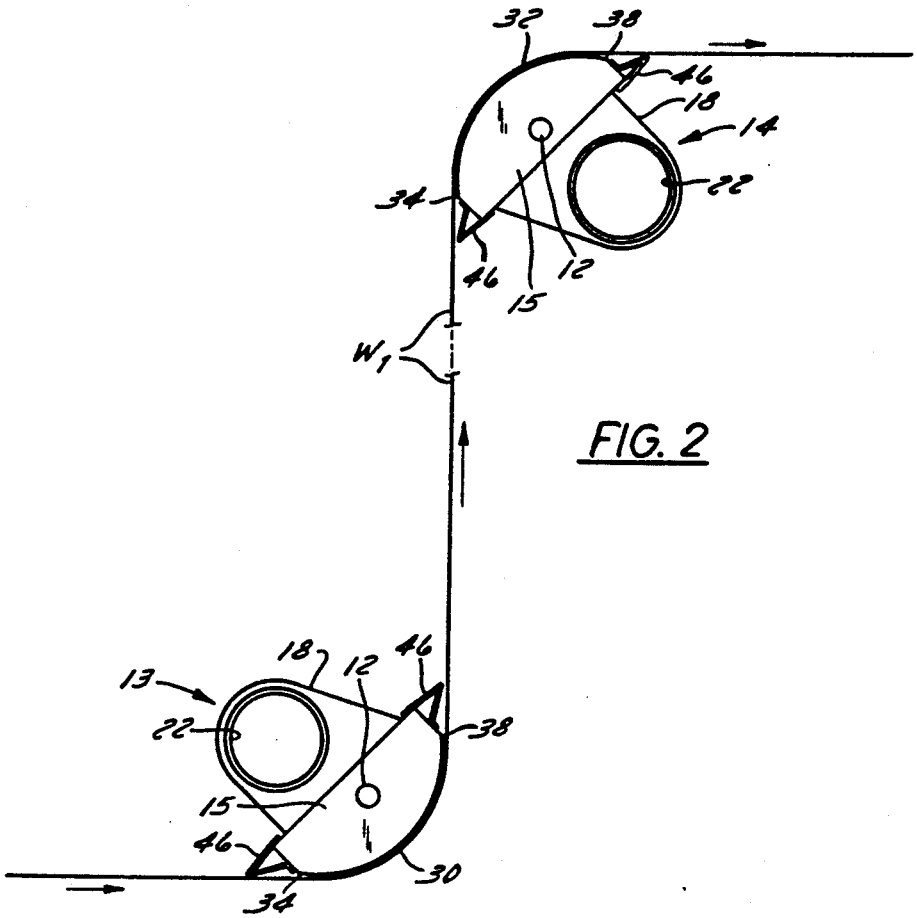
FIG. 2 is a schematic, elevational view of the air turns shown in FIG. 1, but on an enlarged scale, of a web being supported by a pair of contactless turning guides having baffles in accordance with the present invention.

Referring now to FIG. 2, the 90° air guides 13, 14 are shown in schematic form, and are similar and only one will be described in detail. The guides include a housing 18 into which extend air duct 22, arcuate housing 26 in arcuate web path surfaces 30, and having leading edge 34 and trailing edge 38. Mounted on the sides of arcuate housing 26 of air turn 13 adjacent its leading edge 34 and trailing edge 38 are baffle means or assemblies 46. It can be seen that baffle means or assembly 46 extends generally radially from the arcuate housing 26 to a point just short of the intended arcuate path of the web W around the air turn 13. It can be seen that web W, in this case moving from left to right as indicated by the arrow, passes over arcuate web path surface 30 of air turn 13 and in doing so turns 90° toward and then over arcuate web path surface of air turn 14 which turns the web 90° into alignment with its original direction of travel for entry into the dryer 10 at the higher elevation.

Figure 3:
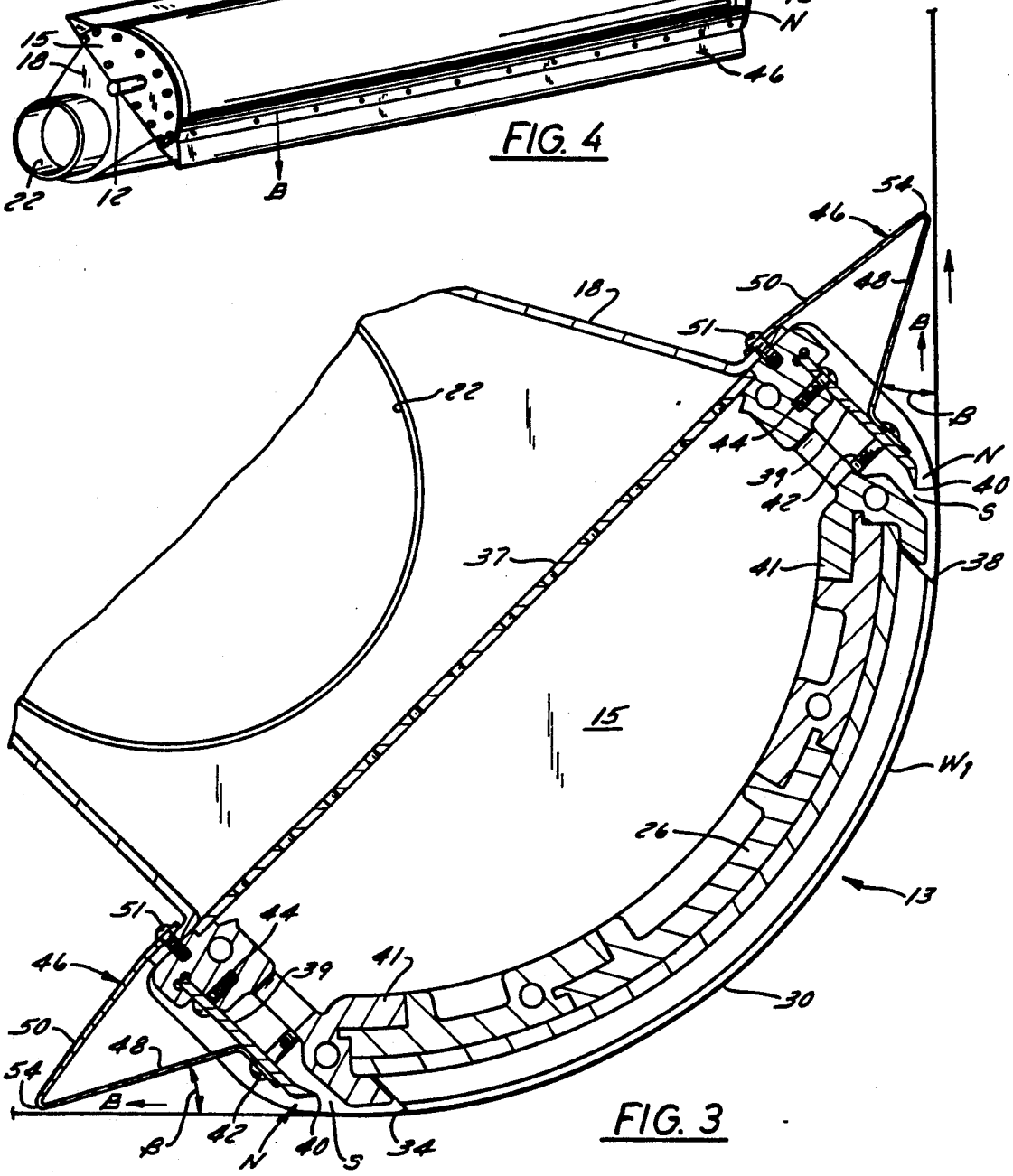
FIG. 3 is an enlarged, cross-sectional view through one of the turning guides shown in FIG. 2.

Referring now to FIG. 3, an enlarged cross sectional view of the air turn 13 is depicted and reference may be had to said U.S. Pat. Nos. 4,938,404 and 4,925,077 for a description of the construction of the arcuate turning guide. The air turn or air guides include a housing 18, auxiliary air duct 22, arcuate housing 26, arcuate web path surface 30 and its leading edge 34 and trailing edge 38. Air is conducted from the auxiliary duct 22 into the housing 18 and then this pressurized air exits from the housing through the perforated air distribution plate 37 which is fixed across the housing. The air distribution plate acts to distribute the air evenly across the length of the air guide.

An air nozzle N is located along the length of each of the leading and trailing edges 34 and 38 respectively of the air turn 13. The nozzle N may be of the type shown in said U.S. Pat. No. 4,925,077 and it is believed sufficient to say that it is formed by a generally straight metal knife member 39 having a sharp nozzle edge 40 which defines a nozzle slot S with part 41 of the air turn. The slots direct air over the arcuate web path surface 30. The nozzle knife member 39 may be affixed to the extruded part 41 of arcuate housing 26 by screws 42 and 44, as also shown in U.S. Pat. No. 4,925,077. Thus pressurized air is directed over surface 30 from each edge and forms an air cushion under the web $W_1$. Most of this air spills out in an opposite direction from surface 30 and it is with this spill-over or waste air that this invention is concerned.

A generally triangular shaped in cross section baffle means 46 fabricated from sheet metal has an outer baffle or active side 48 and an inner rigidifying side 50. Side 50 is affixed to the extruded part 41 of the air turn by screws 51. The air baffle 48 is fixed by bolt or screw 42 to air turn part 41.

Thus, the baffle means 46 of the preferred embodiment is generally triangular in shape and may in a preferred embodiment be made preferably of rigid metal such as 20 gauge stainless steel. An active air supporting side or baffle 48 of the baffle means extends away from each side of the accurate guide and generally along the intended web path but at a converging angle therewith. The baffle means 46 extend generally coextensive in length with the transverse length of the nozzle N between the air turn side frames 15. The active side or baffle 48 of the baffle means 46 in a preferred embodiment extends generally in a direction along the path of travel of the web. More specifically, the air supporting side 48 is arranged at a converging angle $\beta$ with the web W in a direction away from the arcuate guide. The side 48 extends out closely adjacent to the intended path of the web W during operation and terminate in a rigid edge 54 closely adjacent to the web. The construction of the baffle assembly insures a stationary and rigid edge 54 adjacent to the web.

The angle $\beta$ (FIG. 3) between the web path as it leaves the edge of the air turn and the baffle or air supporting side 48 should be a converging angle. This has been found by our experiments to prevent excessive vibration and flutter of the web W.

OPERATION

Pressurized air is introduced into the arcuate housing 26 and through nozzle N forming a pressurized cushion between the web W and the arcuate web path surface 30. Although pressurized air is directed from the nozzle N inwardly over the arcuate surface 30, there is always spill-back or outflowing waste air moving in the direction of the arrows B (FIG. 4) off both the leading and trailing edges 34 and 38 respectively. This backflow air in the direction of arrow B causes the web to vibrate or flutter in prior art devices. The baffle means 46 of the present invention unexpectedly prevent flutter and high frequency vibration of the web from occurring.

Although applicants wish not to be bound by any particular theory of operation, it is believed that the active side or baffle 48 of the baffle means 46, which converge with the web W in a direction away from the guide at both the leading and trailing edges 34 and 38 of the arcuate surface 30, increases the velocity of the waste air by forcing it through a diminishing channel toward the outer tip 54 of the baffle 46, thereby lowering the turbulence generated in the waste air to prevent vibration and flutter. It is known that such vibration and flutter is aggravated at low web tensions, and the air turn of the present invention eliminates these problems even at low web tension.

The baffle means of the present invention may be mounted in other ways and take other shapes, but the portion of the baffle means which dampens web vibrations and flutter by channeling spill-back or waste air is the active, air supporting baffle or side 48 adjacent the web W. Conceivably other generally straight member of sufficiently high rigidity fastened to the air turn 13 adjacent either the leading or trailing edge of the arcuate surface 30 and converging upon the intended path of the web W will achieve the beneficial results of the present invention.

We claim:

1. A contactless turning guide for floatingly suspending a running web in an arcuate path, said guide comprising, a housing having an arcuate surface extending in the direction of web travel, said guide having leading and trailing edges, air supply nozzle means mounted adjacent and parallel to said leading and trailing edges and extending transversely of the path of said web over said arcuate surface, said nozzle means acting to supply air over said arcuate surface, and baffle means extending from adjacent each of said edges and in a direction away from said arcuate surface, for increasing the velocity of waste air spilling off of said leading and trailing edges and thereby decreasing the pressure of said waste air on said web outwardly from said guide.

2. The turning guide as defined in claim 1 wherein said baffle means comprises a rigid side mounted adjacent and generally parallel to the leading and trailing edges and extending away from said guide.

3. In a turning guide for a running web and having an arcuate surface extending in the direction of web movement and over which arcuate surface the running web is floatingly suspended on a cushion of air, said surface having leading and trailing edges transverse to the direction of web travel, a rigid baffle adjacent the leading and trailing edges and generally parallel thereto and extending toward and converging with the web in a direction away from said guide.

4. The turning guide as defined in claim 3 wherein the baffle comprises an active side adjacent said web and a rigidifying side integral with said active side.

5. A turning guide for a running web and having an arcuate surface extending in the direction of web movement said arcuate surface having leading and trailing edges extending transversely across the web, and baffle means mounted adjacent said leading and trailing edges and transversely across said web and extending substantially to and converging with the intended path of said web in a direction away from said guide.

6. In combination with a web printing press for a running web, a web dryer for receiving said web from said press, and a turning guide for floatingly guiding said web from said press to said dryer, said guide comprising a housing having an arcuate surface with leading and trailing edges, an air slot nozzle on said housing and mounted adjacent and parallel to each of said leading and trailing edges and extending transversely of the path of said web, said slot nozzles directed over said arcuate surface, and an air baffle mounted adjacent and generally parallel to the leading and trailing edges and having an air supporting active side extending away therefrom and generally along the traveling web, said active side acting to increase the velocity of waste air spilling off of said leading and trailing edges and thereby decreasing the pressure of said waste air on said web outwardly from said guide.

7. In a contactless turning guide for floatingly suspending and guiding a running web and having an arcuate surface extending in the direction of web movement and over which arcuate surface the running web is floatingly suspended on a cushion of air, said surface having leading and trailing edges transverse to the direction of web travel, an air supply slot nozzle adjacent each of said edges for directing air over said arcuate surface, a rigid baffle adjacent each of the leading and trailing edges extending away from said edges, said baffle including an active air supporting side converging with the web in a direction away from said guide, said side acting to increase the velocity of waste air spilling off of said leading and trailing edges and decreasing the pressure of said waste air on said web outwardly from said guide.

8. The turning guide as defined in claim 7 wherein the baffle is fabricated from sheet steel and is of generally triangular cross section, said active air supporting side rigidly secured to said arcuate surface.

9. In an apparatus for processing a running web, a web press, web dryer, and contactless turning guides which floatingly convey the web from the web press to the web dryer, said guides comprising a housing having an auxiliary air duct extending thereinto and an arcuately curved web path surface extending in the direction of web travel, said surface having circumferentially spaced apart leading and trailing edges and arranged transverse to the direction of web travel, air supply nozzle slots oriented along and adjacent said leading and trailing edges, for supplying air between said arcuate surface and said web, baffle means mounted adjacent said edges and positioned transversely across said web and extending generally along and converging with the intended path of web travel in a direction away from said edges, said baffle means acting to cause an increase in velocity of waste air from said nozzle slots which spills off of said guide surface edges and thereby causes a decrease in the pressure of said waste air on said web.

10. A contactless turning guide for floatingly suspending a running web in an arcuate path, said guide comprising, a housing having an arcutate surface extending in the direction of web travel, said guide having leading and trailing edges, air supply nozzle means mounted adjacent and parallel to said leading and trailing edges and extending transversely of the path of said web over said arcuate surface, said nozzle means acting to supply air over said arcuate surface, and a rigid baffle having an active air supporting side extending from adjacent at least one of said edges in a direction away from said arcuate surface, said side extending generally co-extensive in length with said nozzle means and parallel therewith, for increasing the velocity of waste air spilling off said edge and thereby decreasing the pressure of said waste air on said web outwardly from said guide.

11. In a contactless turning guide for floatingly suspending and guiding a running web and having an arcuate surface extending in the direction of web movement and over which arcuate surface the running web is floatingly suspended on a cushion of air, said surface having leading and trailing edges transverse to the direction of web travel, an air supply slot nozzle adjacent each of said edges for directing air over said arcuate surface, a rigid baffle adjacent at least one of said edges and extending away from said edge, said baffle including an active air supporting side converging with the web in a direction away from said guide, said side extending generally coextensive in length with said slot nozzle and parallel therewith, said side acting to increase the velocity of waste air spilling off of said leading and trailing edges and decreasing the pressure of said waste air on said web outwardly from said guide.

12. The turning guide as defined in claim 11 wherein the baffle is fabricated from sheet steel and is of generally triangular cross section, said active air supporting side rigidly secured to said arcuate surface.

* * * * *